United States Patent [19]

Merlau

[11] Patent Number: 5,048,254

[45] Date of Patent: Sep. 17, 1991

[54] PREFABRICATED BUILDING PANEL

[75] Inventor: Richard A. Merlau, Elkhart Lake, Wis.

[73] Assignee: Valders Stone and Marble, Inc., Valders, Wis.

[21] Appl. No.: 429,856

[22] Filed: Oct. 31, 1989

[51] Int. Cl.[5] ..... E04B 1/41

[52] U.S. Cl. ..... 52/475; 52/506; 52/509; 52/510; 52/513; 52/704; 52/787; 52/235

[58] Field of Search ..... 52/235, 134, 135, 293, 52/238.1, 698, 506, 596, 787, 475, 509, 510, 511, 513, 704

[56] References Cited

U.S. PATENT DOCUMENTS

| | | | |
|---|---|---|---|
| 2,235,356 | 3/1941 | Byers | 52/584 |
| 2,772,560 | 12/1956 | Neptune | 52/698 |
| 2,935,865 | 5/1960 | Munro . | |
| 3,357,144 | 12/1967 | Chauveau et al. | 52/97 |
| 3,478,480 | 11/1969 | Swenson | 52/396 |
| 3,685,228 | 8/1972 | Pauley | 52/506 |
| 3,719,014 | 3/1973 | Sukolics | 52/235 |
| 3,786,605 | 1/1974 | Winfrey | 52/235 |
| 4,009,549 | 3/1977 | Hala | 52/506 |
| 4,021,989 | 5/1977 | Hala | 52/713 |
| 4,045,933 | 9/1977 | Grillo | 52/475 |
| 4,060,951 | 12/1977 | Gere | 52/508 |
| 4,342,179 | 8/1982 | Hill | 52/293 X |
| 4,342,199 | 8/1982 | Hill | 52/155 |
| 4,364,213 | 12/1982 | Biesanz, Sr. | 52/309.17 |
| 4,422,275 | 12/1983 | Baetje | 52/509 |
| 4,525,965 | 7/1985 | Woelfel | 52/309.17 |
| 4,620,403 | 11/1986 | Field | 52/480 |
| 4,719,727 | 1/1988 | Cooper et al. | 52/126.6 |
| 4,719,730 | 1/1988 | Winkowski | 52/238.1 |
| 4,719,730 | 1/1988 | Winkowski | 52/238.1 |
| 4,724,637 | 2/1988 | Evans | 52/209 |
| 4,765,112 | 8/1988 | Lafayette, Jr. | 52/511 |
| 4,766,143 | 10/1988 | Pointner | 52/506 |
| 4,768,322 | 9/1988 | Kafarowski | 52/235 |
| 4,774,791 | 10/1988 | Kafarowski | 52/235 |
| 4,776,143 | 10/1988 | Pointner | 52/506 |
| 4,783,941 | 11/1988 | Loper et al. | 52/235 |
| 4,835,923 | 6/1989 | Ybarra | 52/238.1 |

FOREIGN PATENT DOCUMENTS 1125986 6/1982 Canada .

*Primary Examiner*—Richard E. Chilcot, Jr.
*Assistant Examiner*—Deborah McGann Ripley
*Attorney, Agent, or Firm*—Merchant, Gould, Smith, Edell, Welter & Schmidt

[57] ABSTRACT

A prefabricated building panel for applying a stone facing to a building wall which utilizes a metal structural frame having a sloped base plate which drains water from behind a plurality of stone panels whose front surfaces form the stone facing and are attached to the structural frame by unitary anchor rods. The lower stone panels on the structural frame have weep holes aligned with the base plate to drain the water. The unitary anchor rods include two anchor pins which are inserted in, and glued to, depressed bores on the rear side of the stone panels, thereby joining the adjacent stone panels together.

11 Claims, 6 Drawing Sheets

FIG. 2C
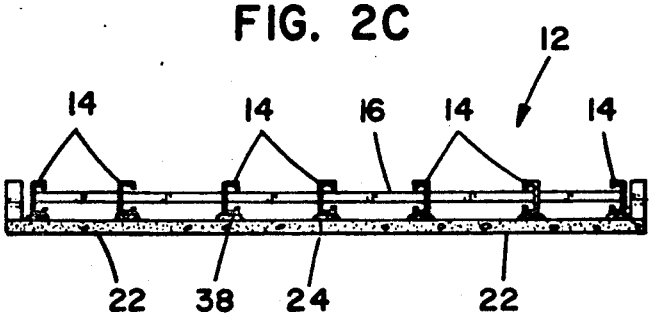
FIG. 2B
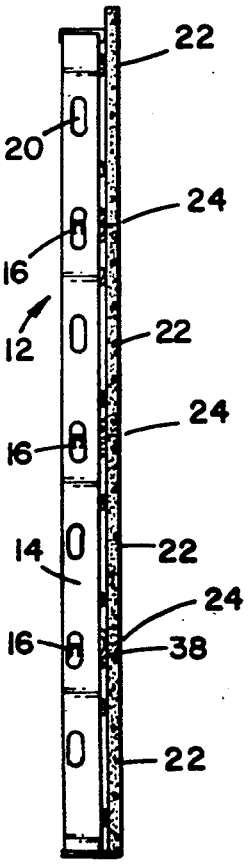
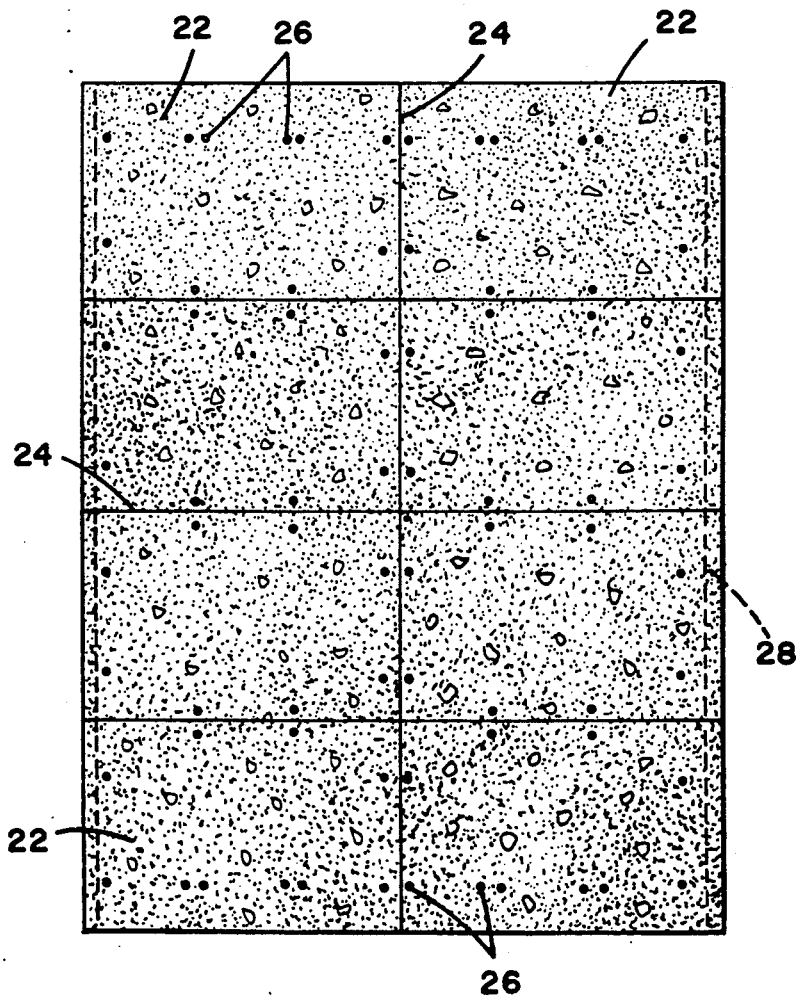
FIG. 2A

PREFABRICATED BUILDING PANEL

BACKGROUND OF THE INVENTION

1. Field of the Invention

The present invention relates to construction materials used to adorn or protect the exterior surfaces of a building. More particularly, the present invention relates to a prefabricated building panel which may be used for applying stone facing to a building.

2. Description of the Prior Art

Because of their pleasing looks and durability, stone facings are frequently used to form the exterior surface of a building. However, past methods of applying stone facings to a building suffered from several drawbacks including excessive time and labor to apply, delays due to inclement weather, and poor quality control.

Another problem frequently encountered when using conventional stone facings is that water, either from precipitation or from condensation, becomes trapped between the stone facings and the building. Such water can cause oxidation of structures used for supporting the stone facings and can cause staining of the stone facings themselves.

It is clear that there has existed a long and unfilled need in the prior art for an external facing which can be erected on a building quickly, easily, and at low cost, and which avoids the problems of water trapped behind the stone facing.

SUMMARY OF THE INVENTION

It is an object of the invention to provide a prefabricated building panel that can be quickly and easily applied on a building and which also prevents the trapping of water between the building and the prefabricated building panel.

In order to achieve the foregoing objectives and others, an apparatus according to the present invention is a prefabricated building panel comprising a structural frame having a sloped base plate for draining water toward the front of the panel assembly; a plurality of stone panels which form the exterior surface of the prefabricated building panel, the bottom stone panels contact the sloped base plate and having weep holes for draining water trapped behind them; an anchor for connecting two stone panels to each other and to the structural frame, the anchor having an elongated rear portion for fastening to the structural frame and at least two anchor pins, one anchor pin inserted into a depressed bore located on the back side of one stone panels and the second anchor pin inserted into a depressed bore on the back of a second stone panel; and an epoxy adhesive for adhering the stone panels to the two anchor pins.

The present invention embraces a method for assembling the prefabricated building panel, including forming a structural frame, creating a plurality of depressed bores in the rear portions of a plurality of stone panels, attaching the elongated part of an anchor assembly to the structural frame, inserting an anchor pin of the anchor assembly into a depressed bore on two stone panels, and applying an epoxy adhesive to attach the stone panels to the anchor pins.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 2A is a rear elevational view of the stone panels of the embodiment of FIG. 1 with the structural frame removed.

FIG. 2B is a side sectional view of the preferred embodiment as shown in FIG. 1.

FIG. 2C is a top plan view of the preferred embodiment shown in FIG. 1, with the horizontal top component removed.

DETAILED DESCRIPTION OF THE PREFERRED EMBODIMENT(S)

Figure 1:
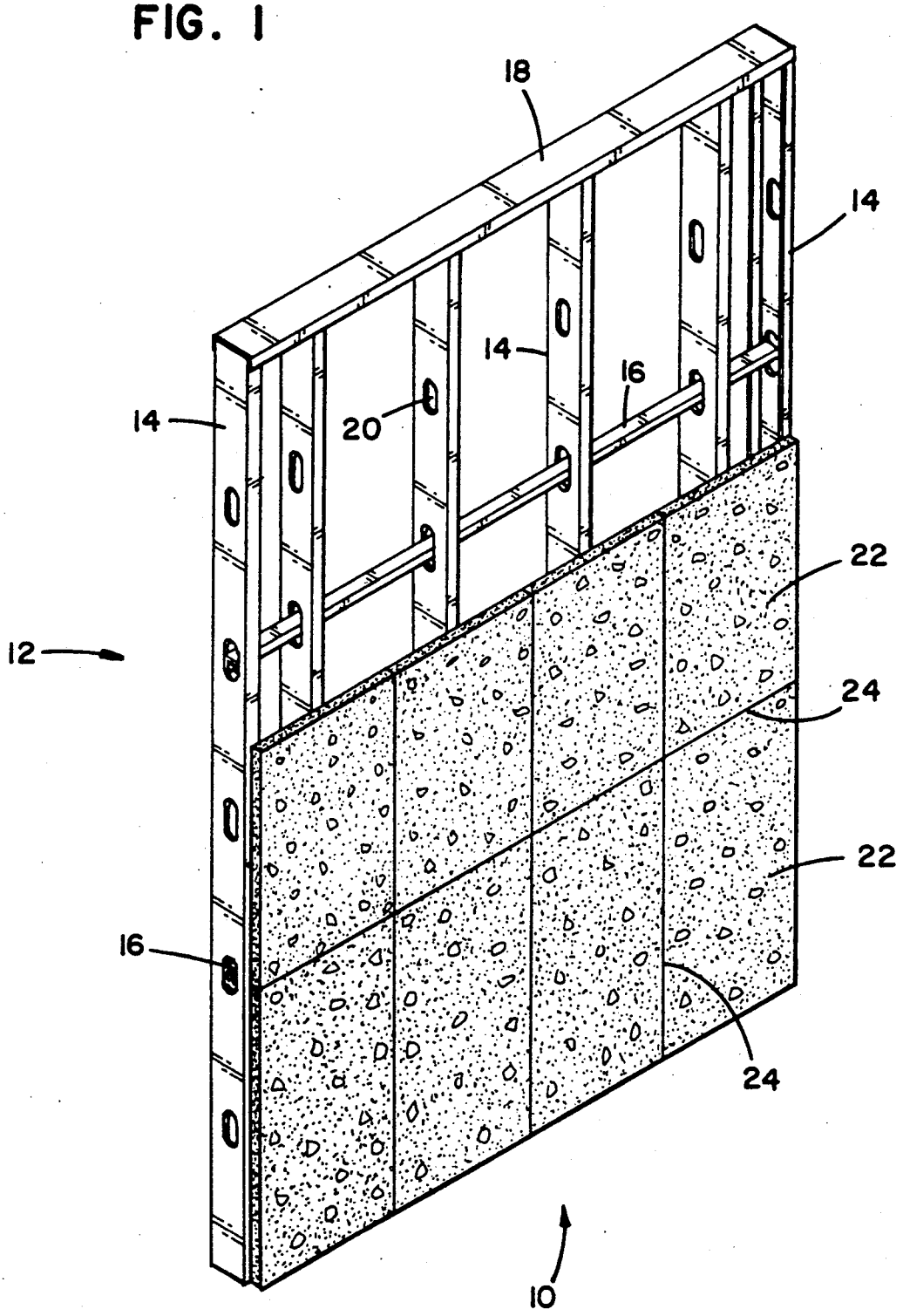
FIG. 1 is an isolated perspective view of a preferred embodiment of the present invention, wherein the top layer of stone panels is removed to reveal the structure behind it.

Referring now to the drawings, wherein like reference numerals designate corresponding elements throughout the views, and particularly referring to FIG. 1, a prefabricated building panel 10 according to the present invention is shown in partial cutaway. Shown is a structural frame 12, which includes vertical frame components 14, bridging members 16 which pass through holes 20 in the vertical frame components 14, and a horizontal top component 18. Also shown are several stone panels 22 which, when fitted together, form joints 24. The stone panels 22 are mounted on the structural frame 12, thereby forming the prefabricated building panel 10. The front surface of the stone panels will form the exterior surface of the building after the prefabricated building panel 10 is installed.

Referring to FIG. 2A, which shows the front side of a complete set of stone panels 22, the junctions of the stone panels 22 form the various joints 24. Included as part of the stone panels 22 are depressed bores 26. These depressed bores 26 are defined in the rear surface of the stone panels 22, preferably toward the outer periphery.

Referring now to FIG. 2B, which shows a side view of the preferred embodiment shown in FIG. 1, the structural frame 12 includes holes 20 defined in the vertical frame components 14, some of which have bridging members 16 passing there through. While the preferred embodiment of the present invention includes the bridging members 16, they are optional. If used they are fixed to the vertical frame components 14 to provide support. Stone panels 22 mount to the structural frame 12, in a manner which will be described in greater detail below. FIG. 2C shows a top plan view of the same structure with the horizontal top component 18 removed for clarity.

Structural frame 12 is preferably made from metal, the most preferable metals being galvanized steel, stainless steel, painted steel, and aluminum. Galvanized steel generally offers the best value when performance and cost are considered. The actual shapes of the structural frame members, such as the bridging members 16, horizontal top component 18, and the vertical frame components 14 can vary. Angles, bent plates, channels, beams or tubes can be used. A stud system comprised of channels as shown in FIG. 3 is the preferred embodiment.

Figure 3:
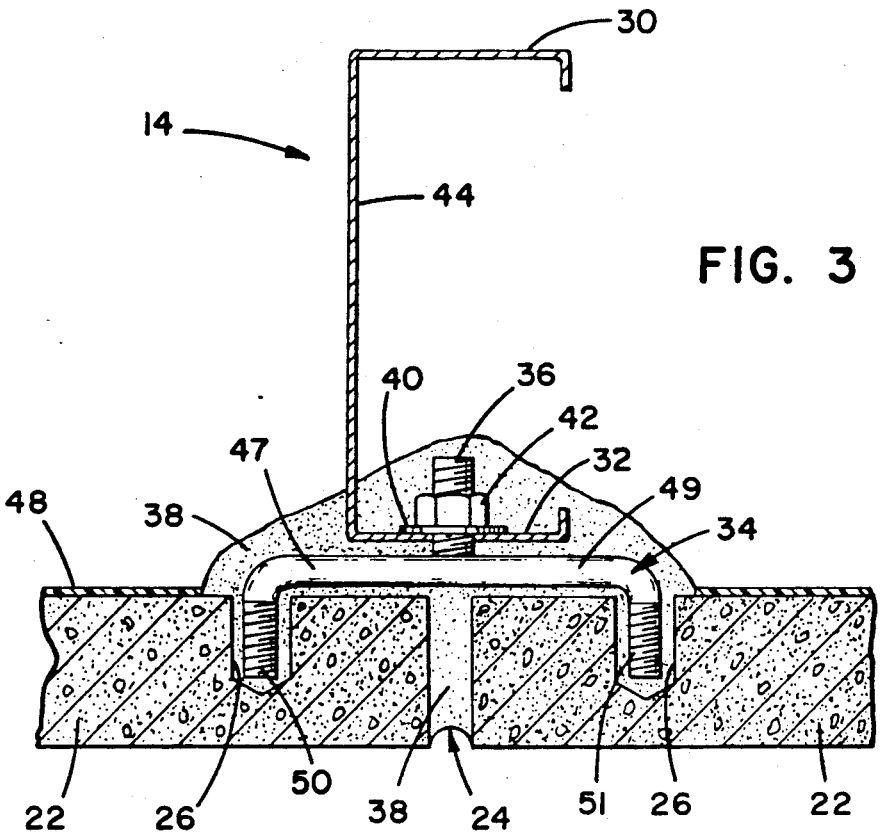
FIG. 3 is a fragmentary, cross-sectional view showing the mounting of two stone panels to the structural frame by means of a U-shaped anchor assembly.

Referring now to FIG. 3, the mounting of the stone panels 22 on structural frame 12 is clearly shown. Vertical frame component 14 has attached to it by a washer 40 and a nut 42 the threaded bolt 36 of a U-shaped anchor assembly 34. Thus, bolt 36, washer 40 and nut 42 together constitute one preferred means for being secured to the frame component 14. Bolt 36 is unitary with the anchor assembly 34, which also includes a first rod portion 47 and a second rod portion 49. First rod portion 47 is bent perpendicularly to form a first anchor pin 50, which inserts into a depressed bore 26 in a rear face of a first stone panel 22, while the second rod portion 49 similarly bends to form a second anchor pin 51, which inserts into a depressed bore 26 in a rear face of a second stone panel 22. Thus, first rod portion 47 and first anchor pin 50 constitute a preferred first means which is adapted for inserting into the depressed bore 26 of the first stone panel 22. Second rod portion 49 and second anchor pin 51 likewise constitute a preferred second insertion means which is adapted for insertion into the depressed bore 26 of the rear surfaces in the second stone panel 22. The anchor pins 50 and 51 are glued inside the depressed bores 26 by an epoxy adhesive 38. Also shown in FIG. 3 is optional waterproofing 48 on the rear surface of the stone panels 22. At the junction of the first and second stone panels is formed a joint 24, which in some embodiments may be partially filled with an epoxy adhesive 38, or other materials.

Anchor assembly 34 joins the two stone panels 22 together and attaches the joined stone panels to the vertical frame component 14. By use of the anchor assembly, adjacent stone panels are linked together. If one of the anchor assemblies should fail, the load of the stone panel attached to the failed anchor assembly would be mechanically transferred to the neighboring stone panels. The anchoring system of the present invention provides flexibility in attaching stone panels 22 to the structural frame 12 to create various patterns. For example, alternate light and dark stone panels could form one design while offsetting adjacent stone panels with respect to their neighbors can produce another design. The optional waterproofing 48 should be used as needed for certain types of stone panels 22, such as water absorbing-type stones.

Figure 4:
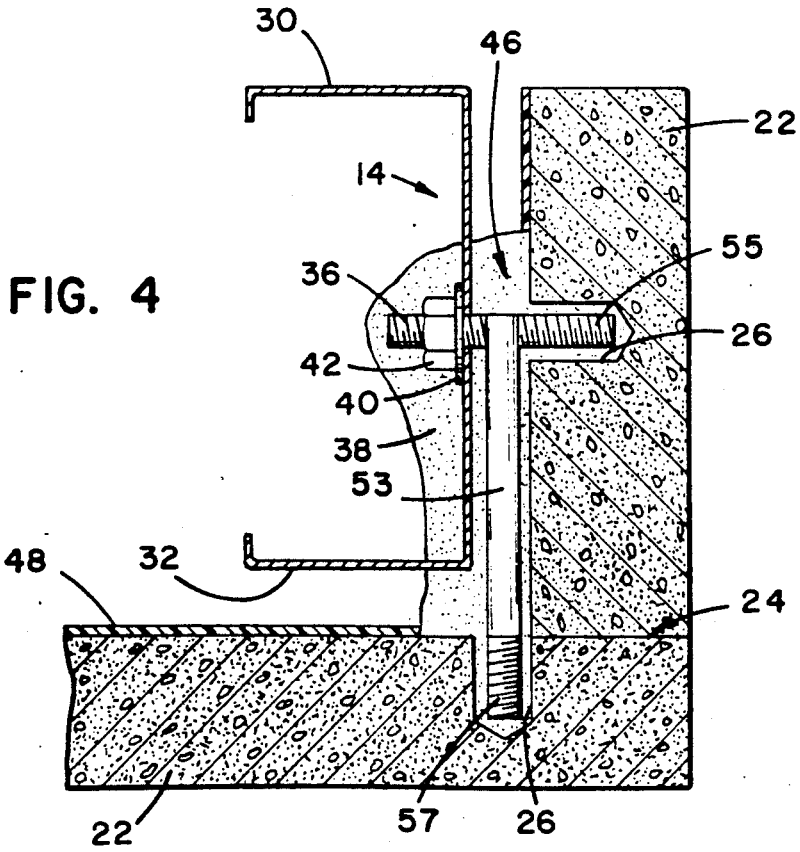
FIG. 4 is a fragmentary, cross-sectional view showing the attachment of two stone panels at a 90-degree angle to the structural frame using a T-shaped anchor assembly.

FIG. 4 shows another method of forming a prefabricated building panel 10 using stone panels 22, which are arranged to form a corner joint. Vertical frame component 14 has a threaded bolt 36 of a T-shaped anchor assembly 46 passing through it and fastened to the vertical frame component 14 with a washer 40 and a nut 42. Bolt 36 is unitary with a third pin 55 which is axially in line with bolt 36 and is also unitary and connected at a right angle to an arm 53 having a fourth pin 57. The third pin 55 enters a depressed bore 26 of a first stone panel 22 while the fourth pin 57 enters a depressed bore 26 of a second stone panel 22. Stone panels 22 form a flush 90-degree angle, creating a joint 24 there between. Epoxy adhesive 38 is deposited on the rear surface of both stone panels and into the depressed bores and on the respective anchor pins 55 and 57. Optional waterproofing 48 may be applied to the rear surface of the stone panels 22.

By use of T-shaped anchor assemblies 46, two stone panels 22 can be fastened to each other at a 90-degree angle and the resulting structure may be attached to vertical frame components 14. In the preferred embodiment, epoxy adhesive adheres the anchor pins 55 and 57 within their respective depressed bores, however, other adhesives or fastening methods can be used. The optional waterproofing 48 should be used as needed as described above.

Figure 5:
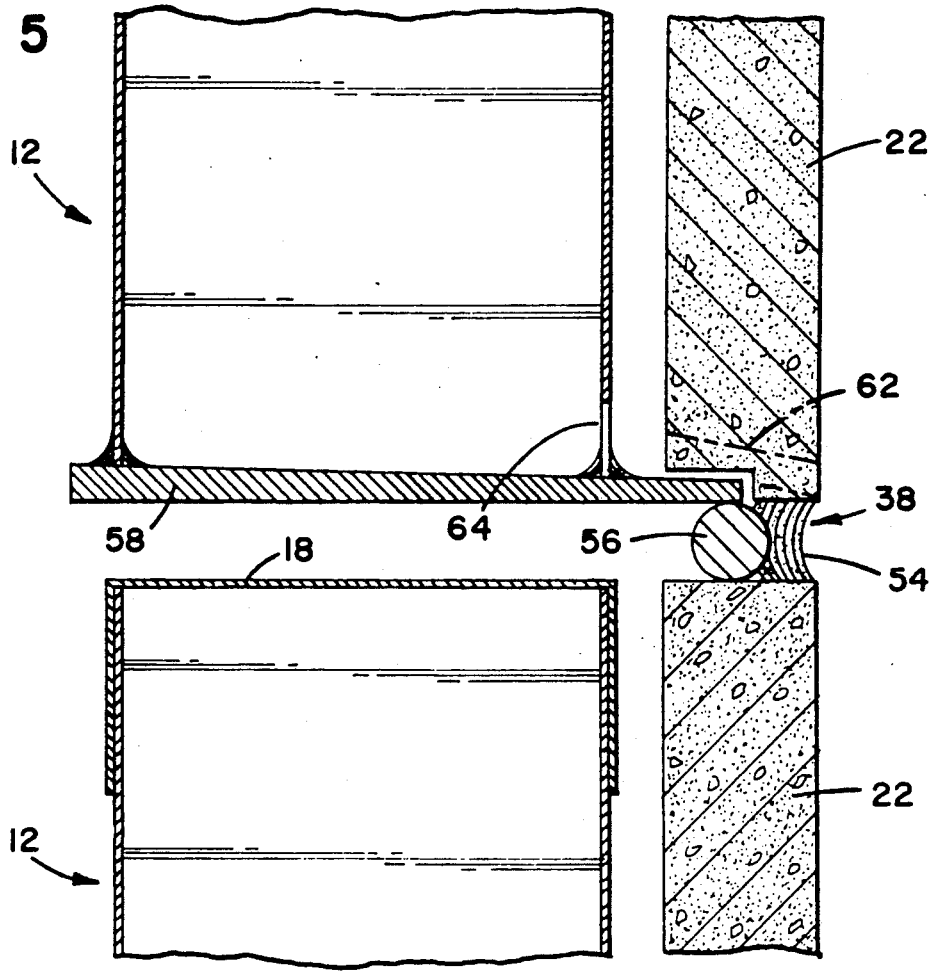
FIG. 5 shows two prefabricated building panels separated by an expansion joint, in which the method of draining water from behind the stone panels by use of a tapered base plate and weep holes in the stone panels is evident.

Referring now to FIG. 5, which shows a side view of the bottom of one prefabricated building panel 10 and the top part of a second prefabricated building panel 10, tapered base plate 58 is tapered from the rear of the structural frame 12 toward stone panels 22, which have several weep holes 62. A drainage hole 64 is included as part of the structural frame 12. Between the first and second prefabricated building panels is a backer rod 56 having a sealant 54 in front of it.

Water, whether from precipitation or condensation, that gets trapped behind the stone panels 22 will tend to fall to the tapered base plate 58. From there the water is channeled forward, through drainage holes 64, into weep holes 62, from which it leaves the prefabricated building panel 10. Backer rod 56 and sealant 54 form an expansion joint between the two prefabricated building panels 10.

Figure 6A:
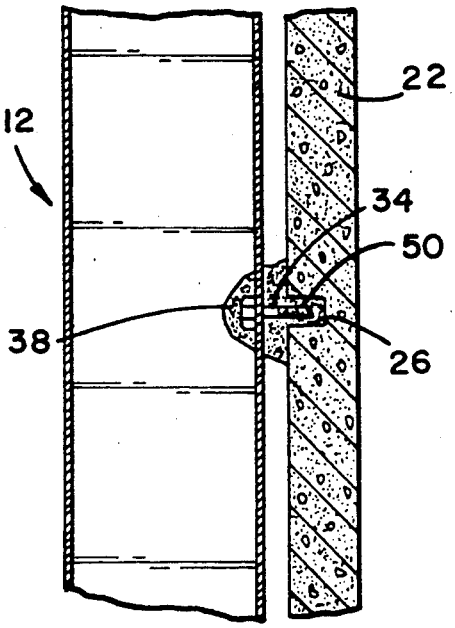
FIG. 6A is a fragmentary, cross-sectional side view of an anchor assembly according to the invention which has straight anchor pins inserted into the stone panels.
Figure 6B:
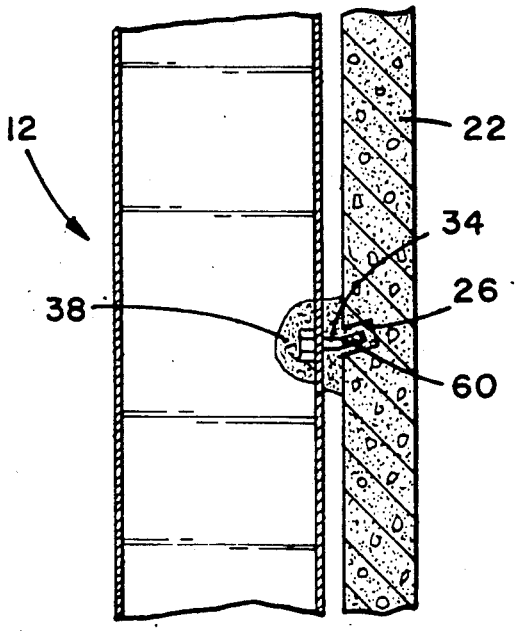
FIG. 6B is a fragmentary, cross-sectional side view of an alternate embodiment of an anchor assembly according to the invention, wherein the anchor pins enter the stone panels at an upward angle.

FIG. 6A shows a cutaway view isolating one embodiment of the present invention. Stone panel 22 connects to the structural frame 12 as described above. The anchor assembly 34 includes a straight pin 50 which is inserted into depressed bores 26 of the stone panel 22. FIG. 6B shows an alternative embodiment. The anchor assembly pin 60 is not straight, but bends upwardly into the depressed bores 26 of the stone panel 22.

The anchoring system of the present invention is flexible enough to allow for incorporation of anchor pins designed to retain stone panels 22 under adverse conditions such as positive and negative wind loads (pressure and suction), extraordinary vertical loads and dynamic loads. The straight anchor pin 50 maybe used for normal use while the upwardly bent anchor pin 60 is preferred for most applications and for stone panels that must withstand high negative loads (suction). Additionally, the upwardly bent anchor pin 60 tends to retain the stone panels to the structural frame if the epoxy adhesive fails, such as occurs if the epoxy adhesive melts during a fire. The major drawback to the upwardly bent pin is that it increases the difficulty of assembling the prefabricated building panel.

The prefabricated building panel 10 has proved to be very flexible. At present a prefabricated building panel can support up to 240 square feet of stone panels 22, but the potential for larger surfaces per building panel exists. The structural frame 12 can be designed from various materials and can take numerous shapes to fit varying needs. As noted previously, the stone panels can be arranged in many patterns and may be waterproofed as required. Additionally, the space created between the building and the stone panels may be used for many purposes, such as locating insulation.

Figure 7:
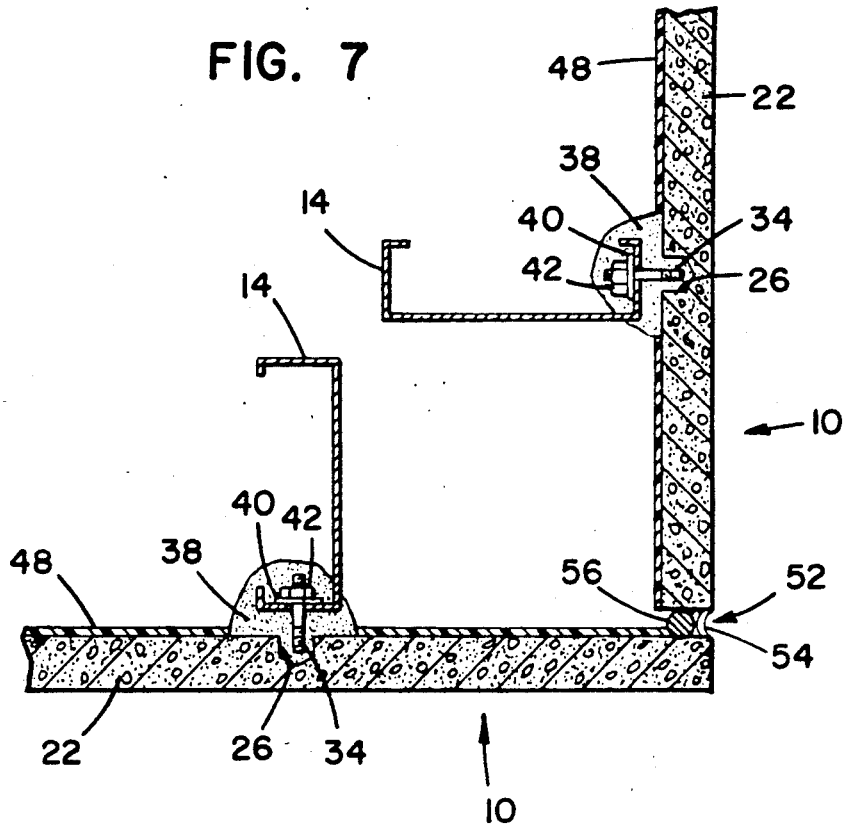
FIG. 7 is a top fragmentary plan view, taken partially in cross-section, of two prefabricated building panels separated by an expansion joint and sealant with a 90-degree corner butt joint.
Figure 8:
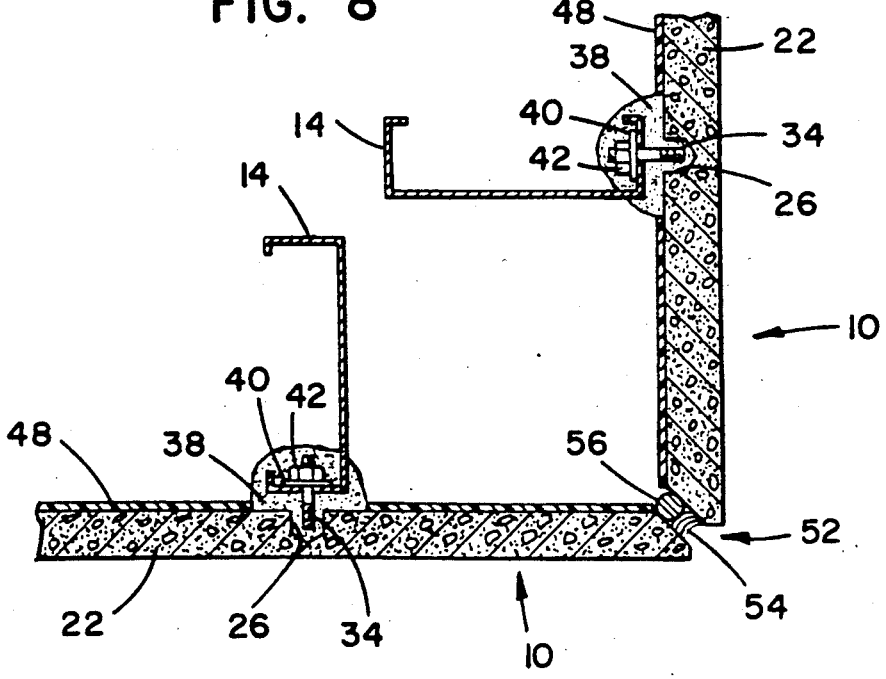
FIG. 8 is a top fragmentary plan view, taken partially in cross-section, of two prefabricated building panels separated by an expansion joint and sealant with a 90-degree quirk miter joint.
Figure 9:
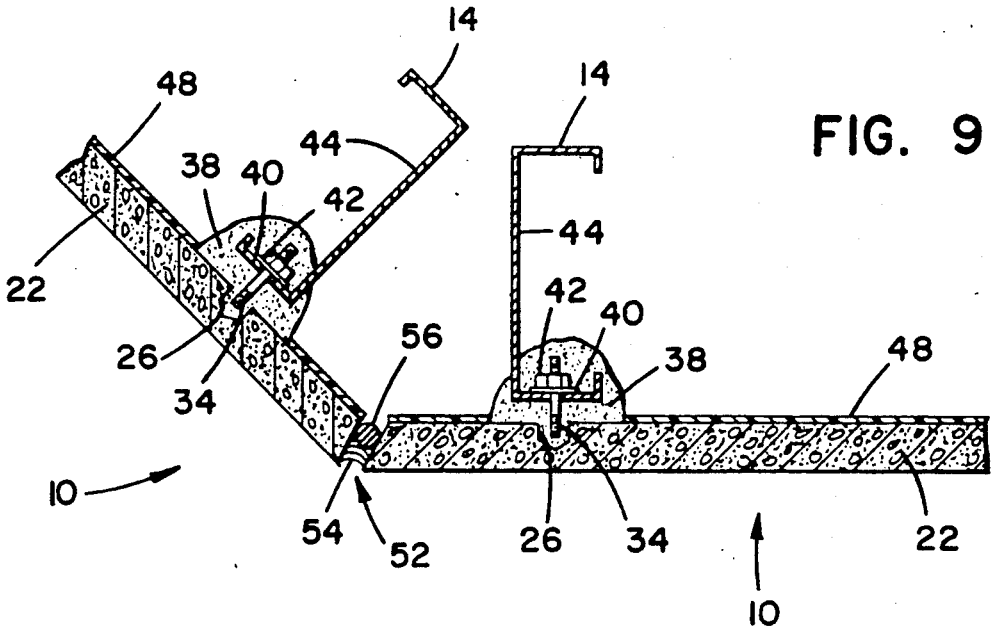
FIG. 9 is a top fragmentary cross-sectional view showing two prefabricated building panels separated by an expansion joint and sealant at a 45-degree exterior corner.
Figure 10:
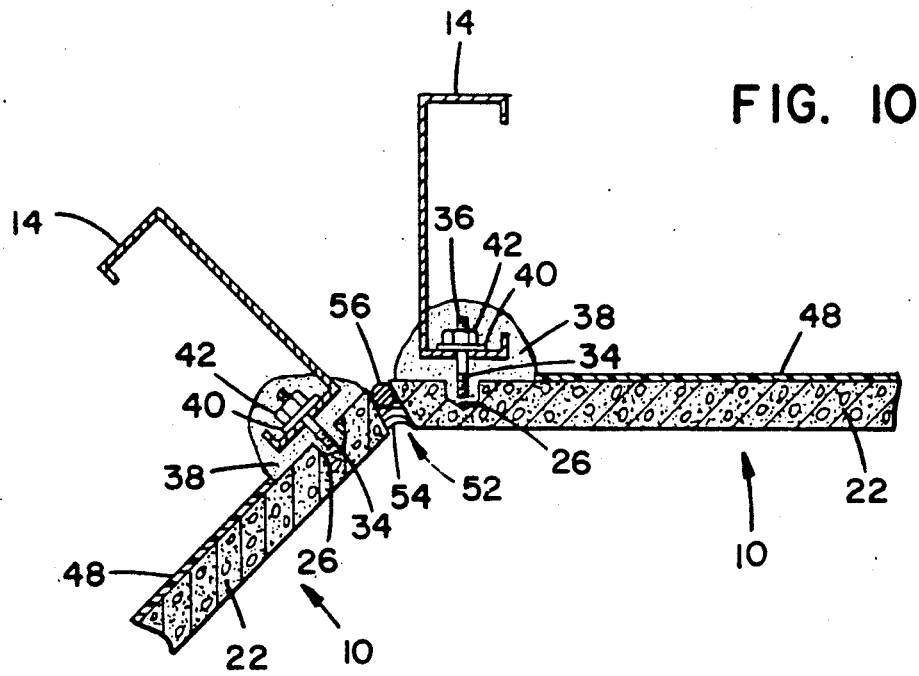
FIG. 10 is a top fragmentary cross-sectional view showing two prefabricated building panels separated by an expansion joint and sealant at a 45-degree interior corner.

The prefabricated building panel 10 is used in forming the exterior surface of a building. One method of using the prefabricated building panels is to stack on top of the other, as shown in FIG. 5. Other methods of using the present invention are shown in FIG's 7–10. FIG. 7 shows two prefabricated building panels according to the present invention joined together at 90-degrees using a butt joint. Included is an expansion joint 52 comprising a backer rod 56 and sealant 54. FIG. 8 shows another representative use incorporating a 90-degree exterior surface formed using a miter joints and including a backer rod 56 and sealant 54. Still other uses are possible. FIG. 9 shows an exterior joint at other than 90-degrees while an interior joint at other than 90-degrees is shown in FIG. 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus adapted for connecting a structural frame element to at least first and second stone panel members of the type having depressed bores defined in rear surfaces thereof, comprising:

securing means which is adapted for securing to the structural frame element;

first insertion means connected to said securing means which is adapted for insertion into the depressed bore in a rear surface of a first stone panel member, said first insertion means extending in the same direction as said securing means and including a third anchor pin which is externally threaded; and second insertion means which is connected to said first insertion means and said securing means and which is adapted for insertion into the depressed bore in a surface of said second stone panel member, whereby said apparatus may rigidly mount said stone panel members to said structural frame element, said second insertion means including a fourth anchor pin which extends in a direction perpendicular to said securing means.

2. The apparatus according to claim 1, wherein the securing means comprises an externally threaded bolt passing through the structural frame element and a washer and a nut securing the bolt element to the structural frame element.

3. The apparatus according to claim 1, wherein said second insertion means includes a fourth anchor pin which is externally threaded.

4. The apparatus according to claim 3, wherein said third anchor pin and said fourth anchor pin angle upward.

5. An apparatus adapted for mounting at least first and second stone panel members of the type having depressed bores defined in rear surfaces thereof on a building, comprising:

a structural frame;

securing means which is adapted for securing to the structural frame element;

first insertion means connected to said securing means which is adapted for insertion into the depressed bore in a rear surface of a first stone panel member, said first insertion means extending in the same direction as said securing means and comprising a third anchor pin which is externally threaded; and second insertion means which is connected to said first insertion means and said securing means and which is adapted for insertion into the depressed bore in a rear surface of said second stone panel member, said second insertion means comprising a fourth anchor pin extending in a direction perpendicular to said securing means, whereby said apparatus may rigidly mount the stone panel members to the structural frame element.

6. The apparatus according to claim 5, wherein the first and second stone panel members have weep holes extending therethrough.

7. The apparatus according to claim 5, wherein the securing means is an externally threaded stud passing through the structural frame element and a washer and a nut securing the stud element to the structural frame element.

8. The apparatus according to claim 5, wherein said fourth anchor pin is externally threaded.

9. The apparatus according to claim 8, wherein said third anchor pin and said fourth anchor pin angle upward.

10. An assembly for connecting to a structural frame of a building for giving the exterior of the building a stone like appearance, comprising:

a first stone panel member having a depressed bore defined in a rear surface thereof;

a second stone panel member having a depressed bore defined in a rear surface thereof;

an anchor member having securing means which is adapted for securing to the structural frame element, a third anchor pin which is inserted into the depressed bore in said first stone panel member, and a fourth anchor pin which is inserted into the depressed bore in said second stone panel member, said third anchor pin being substantially perpendicular to said fourth anchor pin; and a polymeric adhesive applied around said third and fourth anchor pins and said depressed bores, whereby said assembly is securely bound together as a unit.

11. An assembly according to claim 10, wherein at least one of said first and second anchor pins is externally threaded.

* * * * *